United States Patent [19]

Päss

[11] Patent Number: 4,838,064

[45] Date of Patent: Jun. 13, 1989

[54] APPARATUS FOR FLANGING AND SWAGING A CYLINDRICAL CAN BODY ON BOTH ENDS

[75] Inventor: Hans-Uwe Päss, Lengede, Fed. Rep. of Germany

[73] Assignee: Lanico-Maschinenbau Otto Niemsch GmbH, Braunschweig, Fed. Rep. of Germany

[21] Appl. No.: 193,249

[22] Filed: May 11, 1988

[30] Foreign Application Priority Data

May 13, 1987 [DE] Fed. Rep. of Germany ..... 3715917

[51] Int. Cl.[4] ..... B21D 51/26

[52] U.S. Cl. ..... 72/84; 72/94; 72/105

[58] Field of Search ..... 72/84, 91, 94, 105, 72/106

[56] References Cited

U.S. PATENT DOCUMENTS

| | | | |
|---|---|---|---|
| 3,754,424 | 8/1973 | Costanzo | 72/105 |
| 4,023,250 | 5/1977 | Sproul et al. | 72/84 |
| 4,272,977 | 6/1981 | Gombas | 72/94 |
| 4,308,737 | 1/1982 | Kannegiesser et al. | 72/91 |
| 4,512,172 | 4/1985 | Abbott et al. | 72/84 |

*Primary Examiner*—Lowell A. Larson
*Attorney, Agent, or Firm*—Herbert Dubno

[57] ABSTRACT

The apparatus for flanging and swaging both ends of a cylindrical can body has at least two axially opposing drivable flanging and swaging heads slidable into a can body each with a radially slidable wobbler braced centrally on a conical piece axially slidable against an inner spring. At least one wobbler comprises two ring members engaged in each other concentrically of which the outer one is stepped to form a circular shoulder for receiving the inner one. The outer ring member supports itself on a collar guided axially slidable along a spindle against an outer spring. The inner ring member, which has an outer diameter which is less than or about equal to the inner diameter of the unflanged can body, supports itself on one side on the conical piece and on the other side on a disk like abutting member. Prior to the deformation forming the flanged edge the outer ring member is displaced axially by engaging the can body to such an extent that the edge region of the can body contacts on the circumferential surface of the inner ring member. On engagement of a flanging and swaging roller a hook like flanged edge arises which is clamped between the flanging and swaging roller and the outer ring member for further deformation.

6 Claims, 3 Drawing Sheets

1
2
3
4
5
6
6'
7
10
11
III

V
V
7
19
26
32

VI
8
7
9
11
19
12
14
13
16
15
18
17
3
32
32a
27
26
30
31
28
29
16

APPARATUS FOR FLANGING AND SWAGING A CYLINDRICAL CAN BODY ON BOTH ENDS

FIELD OF THE INVENTION

My present invention relates to an apparatus for flanging and swaging both ends of a cylindrical can body. In the following the expression "swaging" is identical to the expression "necking".

BACKGROUND OF THE INVENTION

An apparatus for flanging and swaging a cylindrical can body on both ends, especially an aerosol spray or beverage can, can comprise at least two flanging and swaging heads for receiving the can body held on a rotatably driven spindle slidable axially opposite each other into the can body.

The flanging and swaging heads each have a radially slidable wobbler abutting on one side centrally on a conical piece slidable axially against an inner spring. Each flanging and swaging head is associated with a pivoting arm equipped with a flanging and swaging roller which is pivotable by at least one cam about an axis parallel to the rotation axis of the spindle so that the flanging and swaging roller is brought into and out of engagement with the wobbler for formation of the flanged and indented edge of the can body by radial displacement of the wobbler.

This apparatus which is described in the brochure: Lanico "Bordel- and Einziehautomat BEA 6-325" (Lanico Prospectus, "Flanging and swaging Unit BEA 6-325") is a completely automatic unit in which the can bodies are fed through the machine with their axes horizontal. Several work stations or biting like planets with the flanging and swaging heads slidable in opposite directions into the can bodies and associated pivoting arms and cams are provided.

During formation of the indented and flanged edges, the can bodies are thrust laterally by the counterpressure and the radial yielding motion of the wobbler in contrast to the aligned longitudinal axes of the flanging and swaging head engaged in the can body and/or of the associated spindle. When an indented flanged edge is made only on one end of the can body, while the other can end is shaped or deformed to provide an unindented or only slightly swaged flanged edge, the can body assumes an inclined position relative to the longitudinal axis of the cooperating spindle.

The can body is not guided exactly during the described displacement and/or inclined position by the yielding of the wobbler disk and/or the wobbler disks and the flanging and swaging rolls acting on the can body and the wobbler at one place on the can circumference.

To assist in guiding a bell can be provided in the form of a ring structure axially behind the wobbler on the spindle which provides a bell like annular surface facing the edge of the can body. The front edge of this can body supports itself on this annular surface during the first part of the deformation of the can body end so that the yielding of the can body during one part of the deformation of its edge region is kept in certain bounds.

However it is not possible to keep guiding the can body during the entire flanging and swaging process by this abutting member bell so that despite the abutting member bell the formation of the flanged and indented edges of the can body are made only with comparatively large variations or tolerances over the entire circumference of the individual can and also from can to can.

These variations occur especially in can bodies which are made from a hard metal sheet. With this hard material in the apparatus known up to now the unavoidable and variable resiliency of the materials in the region of the flanging and swaging head acts so that it has been impractical up to now to use a hardened metal sheet, especially a doubly reduced metal sheet, for making the can body although metal sheet of the hardened type is economical and can be used in a substantially thin walled form for the can body. Up to now the metal plate or sheet used for this type of can body has been only slightly hardened.

OBJECTS OF THE INVENTION

It is an object of my invention to provide an improved apparatus for flanging and swaging a can body on both ends which does not have the above mentioned disadvantages and difficulties.

It is also an object of my invention to provide an improved apparatus for flanging and swaging a can body on both ends with which the deformation of the flanged and indented edges of the can body is attained with a greater accuracy than has been the case up to now.

It is another object of my invention to provide an improved apparatus for flanging and swaging a can body at both ends which can provide a can body with a flanged and indented end in a working process which manufactures the can body from a doubly reduced metal sheet or other sheet with a Rockwell hardness of about 60 HR 30T or greater.

SUMMARY OF THE INVENTION

These objects and others which will become more readily apparent hereinafter are attained in accordance with my invention in an apparatus for flanging and swaging a cylindrical can body on both ends, especially an aerosol spray or beverage can, with which the flanging and swaging proceeds in a single working process.

This apparatus comprises at least two flanging and swaging heads for receiving the can body held on a rotatably driven spindle slidable axially opposite each other into the can body to receive the can body. The flanging and swaging heads each have a radially slidable wobbler abutting on one side centrally on a conical piece slidable axially against an inner spring.

Each flanging and swaging head is associated with a pivoting arm equipped with a flanging and swaging roller which is pivotable by at least one cam about an axis parallel to the rotation axis of the spindle so that the flanging and swaging roller is brought into and out of engagement with the wobbler for formation of the flanged and indented edge of the can body by radial displacement of the wobbler.

According to my invention at least one wobbler of the swaging heads cooperating with each other each comprise two concentric ring members engaged with each other, of which the outer one having a larger outer diameter is stepped for receiving the inner one of a smaller outer diameter and supports itself on a collar guided axially slidable against an outer spring on the spindle so that the inner one of the ring members whose outer diameter at most corresponds to the inner diameter of the can body before the flanging process supports itself on the conical piece and the disklike abutting member and the ring members have bounding surfaces whose outer circumferential fits the shape of the flanged and indented edge.

By the structure of the apparatus according to my invention the can body to be processed can be received between the cooperating flanging and swaging heads so that it supports itself on the outer ring member of the wobbler at least with its one front end and a further opposing axial motion of the cooperating flanging and swaging heads causes an axial displacement of the outer ring member on simultaneous engagement of the inner ring member in the edge of the can body to be flanged.

With appropriate dimensions for the outer circumference of the inner ring member the end portion of the can body contacts the outer circumference of the inner ring member before the flanging and swaging roller is brought into contact with the can body. Thus the end portion of the can body contacting on the inner ring member at the beginning of the deformation is bent hooklike and is squeezed against the flanging and swaging roller by the outer ring member which is under the compression force provided by an outer spring. Hence it is held in contact with the flanging and swaging roller and of course also during the further deformation process until the flanging and swaging roller act together with the circumferential surfaces of the inner ring member.

At this stage the flanged edge is substantially finished On further clamping or gripping of the flanging and swaging roller the swaging is performed by radial displacement of both ring members forming the wobbler so that the outer edge region of the flanged and indented edge of the can body is held continuously under the action of the outer ring member acted on by the outer spring.

In the described manner the can body is guided reliably in the vicinity of the indented and flanged edge during the deformation of the edge and with its end edge region held clamped in the vicinity of the cooperating flanged and indented roller with the wobbler.

Because at the beginning of the deformation a comparatively small end edge zone is bent over in an approximately radial direction a structural stabilization of the edge of the can body to be deformed occurs so that tear formation is avoided and subsequently the flanged and indented edge is formed in a satisfactory way. Experience has shown also that when doubly reduced metal sheet and/or sheets with a Rockwell hardness of 60 HR 30T or more are used practically no springing back or return of the edge occurs after the forcing back and release of the indented and flanged can edge.

According to the type of can to be provided with a flanged and indented edge the cooperating flanging and swaging heads according to my invention can be made so that commonly different depth flanged and indented edges can be provided at both ends of the can body if required or desired.

A particularly simple structure for the apparatus of my invention results when the outer ring member has an L-shape cross section whose short leg forms an outer axially resilient ring segment of this ring member for guiding the opposing ring member.

To guarantee that both ring members do not become disengaged, the path of the slidable collar on the spindle is limited by a stop so that its displacement is smaller than the depth to which the inner ring member is engaged in the cuter ring member. Thus the sleeve in a simple way has an inwardly directed circular shoulder acting as the stop which cooperates with a ring shape front surface formed by the spindle.

To attain as smooth as possible a beveled transition from the undeformed portion of the can body to the flanged and indented edge and to increase the stability of the shape of the flanged and indented edge, the disk-like abutting member is provided on its side facing the wobbler with a fitting surface on its cuter edge.

This fitting surface acts as a stop and an abutting surface for the above named transition region of the indented and flanged edge in the undeformed can body. A rolling working of the region of the can body located between the flanged and indented roller and the fitting surface of the abutting member occurs toward the ends of the deformation of the flanging and swaging edge with a suitable shape for the fitting surfaces fit against the circumferential surfaces of the flanging and swaging roller. Hence the stability of the shape of the flanged and indented edge is additionally increased.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figures 1, 2, 3:
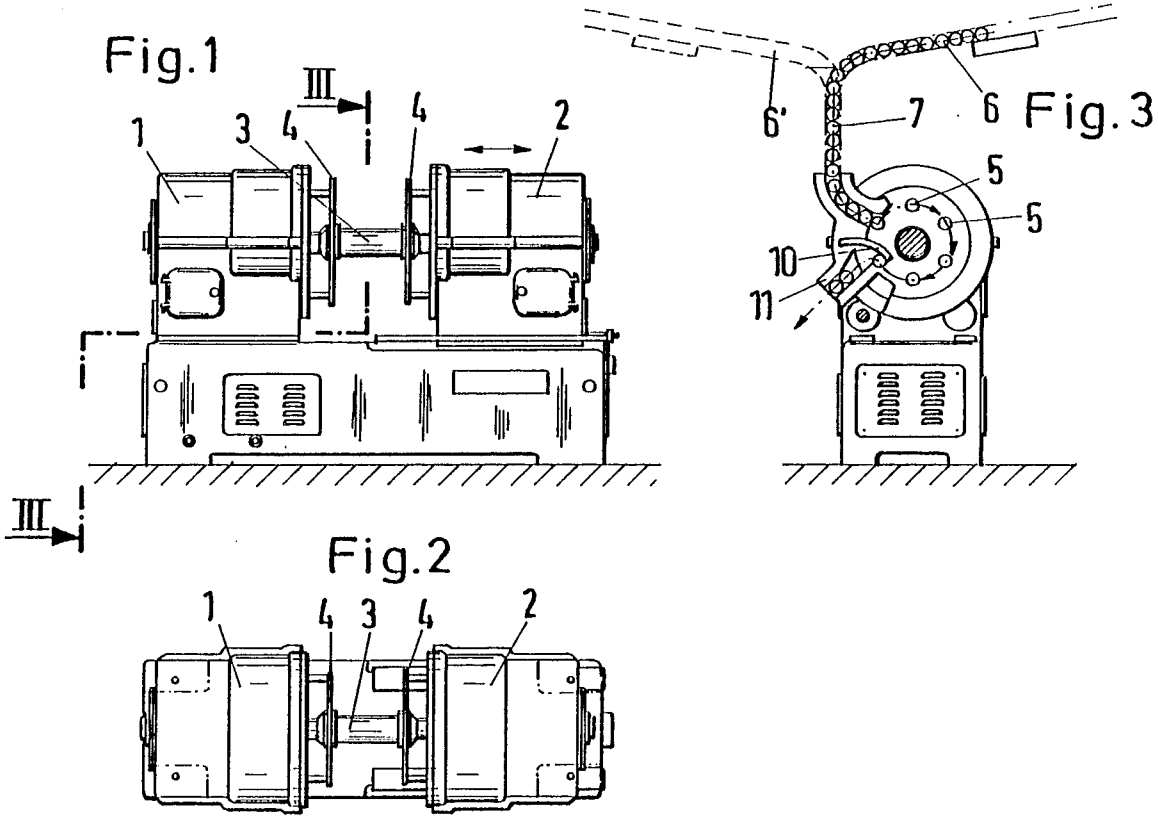
FIG. 1 is a side elevational view of one basic structure of an apparatus for flanging and swaging a can body with six work stations orbiting like planets.
FIG. 2 is a top plan view of the apparatus according to FIG. 1.
FIG. 3 is a cross sectional view taken along the section line III—III in FIG. 1 with a diagrammatically shown feed mechanism.

The apparatus reproduced in FIGS. 1 and 3 comprises two drive units 1 and 2 which are mounted on a base frame and are controlled by a synchronizing mechanism so that they drive a central shaft 3 jointly. Two guide disks 4 in which holes or sockets for the can bodies are located are provided spaced from each other on the central shaft 3. The guide disks 4 have cut out portions for the tools for flanging and swaging the ends of the can bodies 7 not shown in detail in FIGS. 1 to 3.

The drive unit 2 is slidably mounted on the base frame for adjustment for can bodies of different lengths by sliding it back and forth in the direction of the double arrow shown above the drive unit 2 in FIG. 1.

The apparatus reproduced in FIGS. 1 and 2 is equipped with six work stations 5 orbiting planetlike to which a can body 7 is conducted or fed through a feed trough 6. An additional or auxiliary feed trough 6' is provided for cases in which the feed of cans 7 through the feed trough 6 is interrupted so that a continuous operation of the apparatus is guaranteed in that case.

During the rotary motion of the work stations 5 the working of the can bodies 7 is effected. The can bodies 7 are shunted to a delivery shaft 11 by a deflector 10 after the process steps are completed. The delivery shaft 11 conveys these finished can bodies 7 away from the apparatus in an unillustrated manner.

Figures 4, 5:
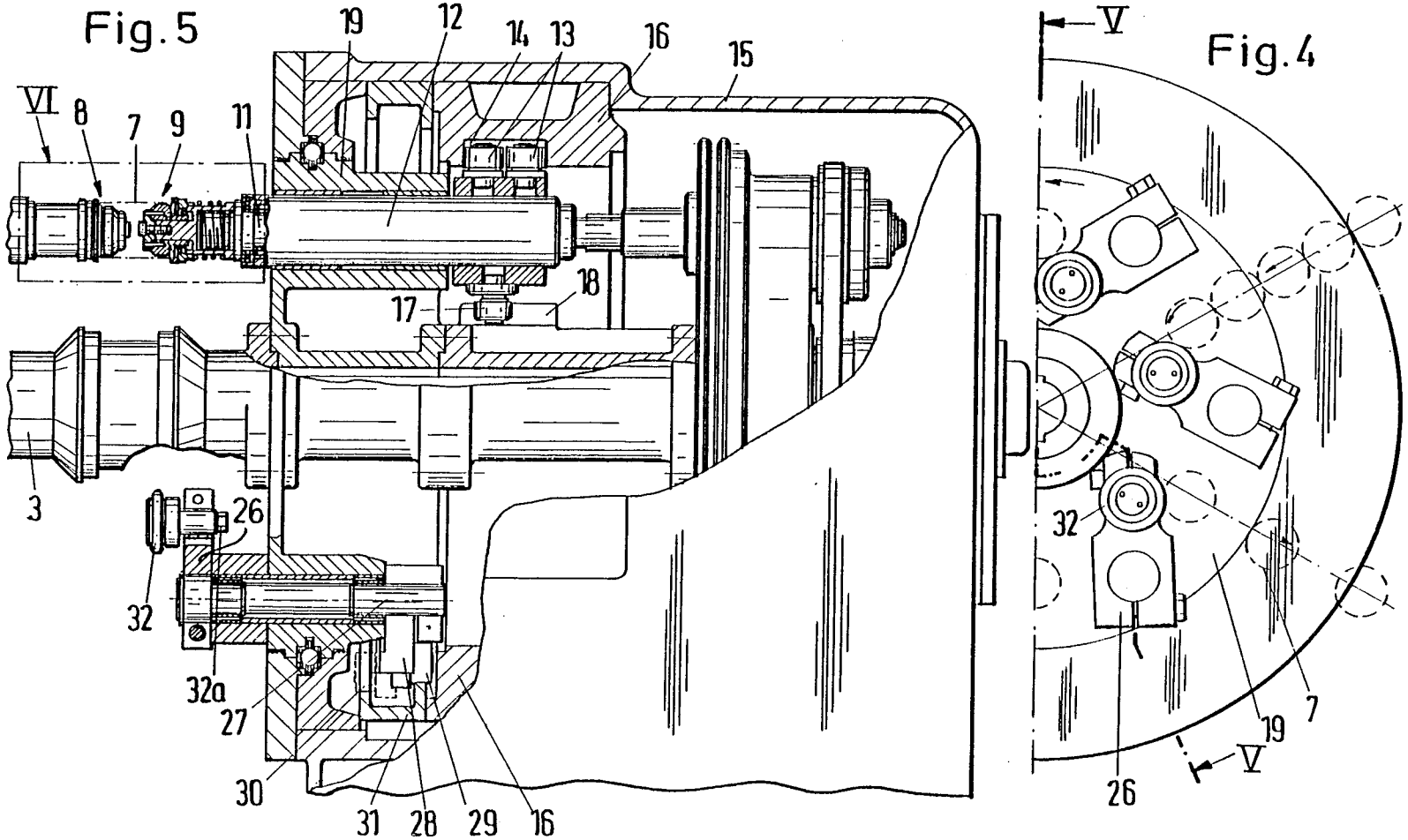
FIG. 4 is a partial front view of one portion of the apparatus according to FIGS. 1 to 3.
FIG. 5 is a cross sectional view taken along the section line V—V in FIG. 4.

The structure of the flanging tool of the individual work stations 5 and its operation are apparent from FIGS. 4 to *7c*.

Figure 6:
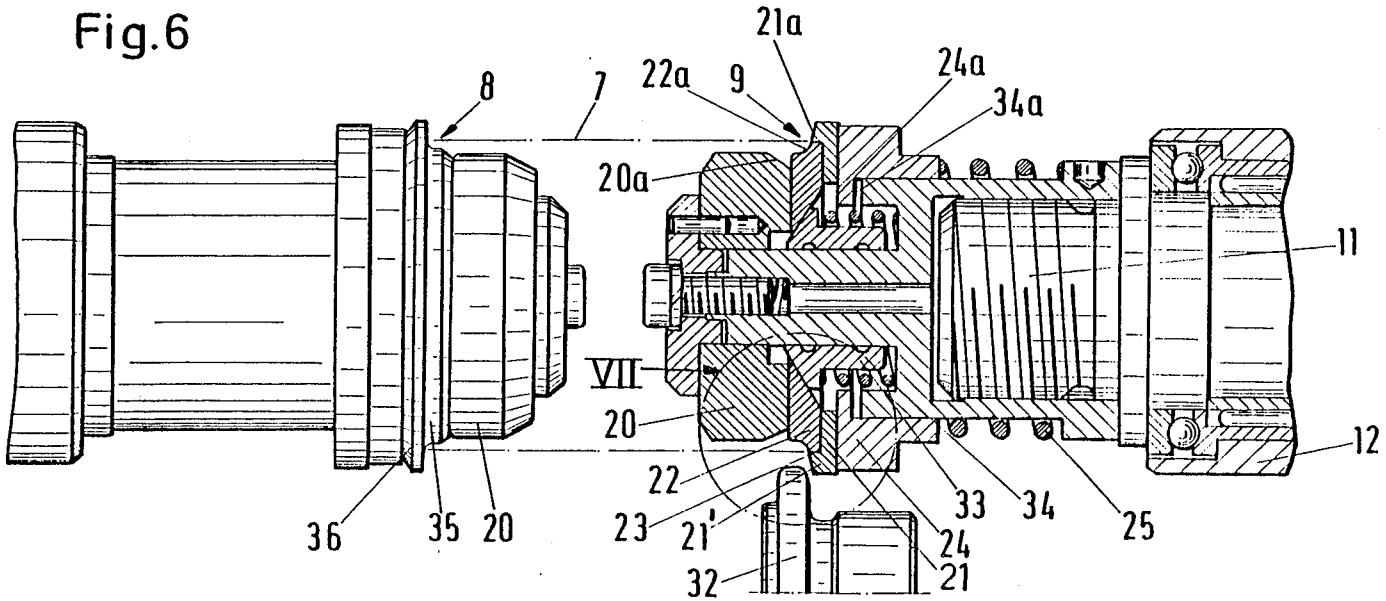
FIG. 6 is an enlarged cross sectional view of the detailed structure indicate with Z in FIG. 5; and FIGS. *7a* to *7c* are cross sectional views of a portion of the structure shown in FIG. 6 inside a circle VI in different configurations during the making of the flange and indentation.
Figure 7A:
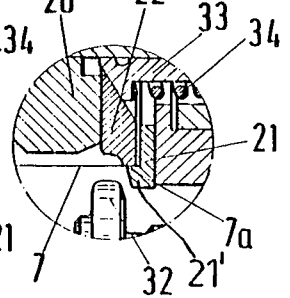
Figure 7B:
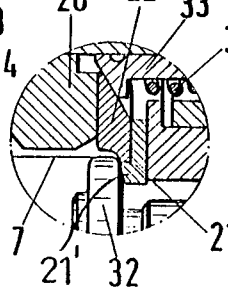
Figure 7C:
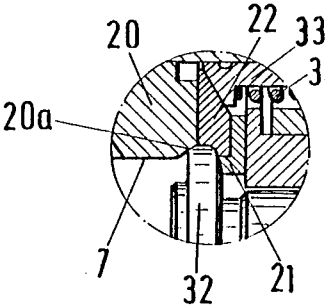

FIGS. 5 and 6 show that the can bodies 7 in the individual axial work stations 5 are held by flanging and swaging heads 8 and 9 movable axially in different directions. In FIG. 5 only one of the drive units 1 and/or 2 is reproduced in partial cross section since the other drive unit has the same structure as the drive unit reproduced in FIG. 5.

According to FIGS. 5 and 6 the flanging and swaging head 9 is attached to a rotating drivable spindle 11. The spindle 11 for its part is held and/or mounted in a feed sleeve 12 A plurality of feed rollers 13 which engage in a groove 14 of a locally fixed ring member 16 held in the housing 15 are connected nonrotatably with the feed sleeve 12. Further a connected guiding collar 17 which cooperates with the guide path 18 extending around the central shaft 3 is attached rigidly with the feed sleeve 12.

The feed sleeve 12 is held in a ringlike mounting member 19 connected with the central shaft 3.

The structure of the flanging and swaging head is seen in detail in a magnified view shown in FIG. 6. Each flanging and swaging head 8 and/or 9 is associated with a pivoting arm 26 held in a ringlike mount member 19 (FIG. 4). The pivoting arm 26 is attached nonrotatably with a rotating axle 27 which for its part engages with a cam 31 by an attached transverse arm 28 and guide rollers 29 and 30 mounted rotatably on it. The cam 31 is held nonrotatably in the ringlike component 16.

A flanging and swaging roller 32 which is held on a rotatable axle 32*a* of the pivoting arm 26 is provided on the free end of the pivoting arm 26.

The flanging and swaging head 9 is attached nonrotatably on the free end of the spindle and has a disklike abutting member 20 as shown in FIG. 6. A wobbler comprising two concentric ring members 21 and 22 of different outer diameters is braced against the disklike abutting member 20. The outer larger ring member 21 of a larger outer diameter has an L-shape cross section and thus forms a stepped circular shoulder 23 which acts to mutually guide both ring members 21 and 22 in their mutual axial shifting. The stepped circular shoulder 23 is formed by an axially directed leg 21' of this ring member 21 which forms an axially resilient ring segment.

The ring member 21 of larger outer diameter is braced on a collar 24 guided axially on the spindle 11 and longitudinally slidable along the spindle 11 against the force provided by an outer spring 25.

The inner held ring member 22 of smaller outer diameter supports itself on the side opposite the disklike abutting member 20 on a conical member 33 which sits under the force provided by an inner spring 34 which acts to force the ring member 22 against the disklike abutting member 20.

The ring members 21 and 22 have bounding surfaces 21*a* and/or 22*a* fitting to the shape of the flanged edge on their outer periphery. These named bounding surfaces correspond approximately to the radial pressing surfaces of the flanging and swaging roller 32.

The collar 24 is limited in its axial displacement motion against the action of the outer spring 25 by a stop which is formed in this embodiment by a ring shoulder 24*a* directed interiorly. The displacement of the collar 24 is determined by the width of the gap 34*a*. This displacement is less than the depth of engagement of the ring member 22 in the ring member 21 of the wobbler.

According to FIG. 6 the disklike abutting member 20 is provided with a fitting surface 20*a* on its outer edge facing the wobbler, i.e. the ring members 21 and 22.

The outer diameter of the ring member 22 is kept less than or equal to the inner diameter of the can body 7 to be flanged.

The cooperation of the flanging and swaging head 9 according to FIG. 6 with the flanging and swaging roller 32 is apparent from FIGS. *7a* to *7c*.

After a can body 7 is positioned between the flanging and swaging heads 8 and 9 having a suitable axial spacing, the heads move axially opposite each other to such an extent that the ring member 21 takes the position shown in FIG. *7a* by action of the can body 7. During the axial shift of the ring member 21 caused by the can body 7 the ring member 22 fitting the inner diameter of the can body 7 pushes the can body 7 in an amount about equal to the axial displacement of the ring member 21. Thus a small edge region *7a* of the can body 7 is braced on the circumferential surface of the ring member 22.

In this position the flanging and swaging roller 32 is pivoted against the flanging and swaging head 9 and deforms the small edge region *7a* of the can body 7 into a hooklike small radial flange. The ring member 21 by action of the outer spring 25 provides for a strong pressing of the hooklike edge region *7a* on the flanging and swaging roller 32 so that this edge region can not spring back or return to its original shape. On continuing this clamping action on the hooklike outer edge region *7a* deformed in the shape of a flange an additional forcing of the flanging and swaging roller 32 until the position shown in FIG. *7c* is arrived at.

In this position the flanging and swaging roller 32 has shoved the ring members 21 and 22 already axially to their final position to form the flanged and indented edge of the can body and of course against the action of the conical piece 33 and the inner spring 34 acting on the conical piece 33. Thus the flanging and swaging roller 32 in this position cooperates also with the fitting surface 20*a* of the disklike abutting member 20 so that a beveled transition of the cylindrical portion of the can body 7 to the flanged and indented edge of the can body arises and the flanged edge additionally is stabilized in its shape by a rolling action.

The structure of the flanging and swaging head 8 reproduced in FIG. 6 in this embodiment differs from the flanging and swaging head 9. The flanging and swaging head 8 is equipped with a one piece wobbler 35 in a conventional way which is surrounded by an axially displaced ring shape abutting bell piece 36 on which the other end of the can body provided with the flanged and indented edge abuts at least during the first part of the flanging and swaging process when the flanging and swaging roller 8 associated with this flanging and swaging head 8 and not shown in the drawing cooperates with the wobbler 35.

In many cases especially when a deep swaging with a flanged edge is required only on one end of the can body it is enough when the structure of only one flanging and swaging head corresponds to that of the invention. Also however both swaging heads can also be simultaneously formed so that different swaging depths can be attained by suitable structuring of the ring member and the forcing in or pressing motion of the flanging and swaging roller.

I claim:

1. In an apparatus for flanging and swaging a cylindrical can body on both ends, especially an aerosol spray or beverage can, with which said flanging and swaging is effected in a single working process and in which at least two flanging and swaging heads held on a rotatably driven spindle slidable axially opposite each other into said can body to receive said can body, said flanging and swaging heads each having a radially slidable wobbler abutting on one side centrally on a conical piece slidable axially against an inner spring and in which each one of said flanging and swaging heads is associated with a pivoting arm equipped with a flanging and swaging roller which is pivotable by at least one cam about an axis parallel to the rotation axis of said spindle so that said flanging and swaging roller is brought into and out of engagement with said wobbler for formation of a flanged and indented edge of said can body by radial displacement of said wobbler, the improvement wherein at least one wobbler of said swaging heads cooperating with each other comprises two concentric ring members engaged with each other, of which the outer one having a larger outer diameter is stepped for receiving the inner one of a smaller outer diameter and supports itself on a collar guided axially slidable against an outer spring on said spindle so that said inner one of said ring members whose said outer diameter at most corresponds to the inner diameter of said can body before said flanging supports itself on said conical piece and said disklike abutting member and said ring members have bounding surfaces whose outer circumference fits the shape of said flanged and indented edge.

2. The improvement defined in claim 1 wherein said outer ring member has an L-shape cross section whose shorter leg forms an outer axially resilient ring segment of said outer ring member for guiding said ring members.

3. The improvement defined in claim 1 wherein the displacement of said slidable collar along said spindle is limited by a stop so that the displacement of said slidable collar is smaller than said engagement depth of said inner ring member in said outer ring member.

4. The improvement defined in claim 3 wherein said collar has a circular shoulder directed inwardly which acts as said stop which cooperates with a ringlike front surface formed on said spindle.

5. The improvement defined in claim 1 wherein the outer edge of said disklike abutting member has a fitting surface on a side facing said wobbler.

6. An apparatus for flanging and swaging a cylindrical can body on both ends, especially an aerosol spray or beverage can, in a single process comprising:

at least two flanging and swaging rollers each mounted on a pivoting arm for deforming said can body which is pivotable by at least one cam about an axis parallel to the rotation axis of a rotatably driven spindle; and at least two flanging and swaging heads mounted on said spindle slidable axially opposite each other into a suitable positioned one of said can bodies to receive said can body, said flanging and swaging heads each having a radially slidable wobbler abutting on one side centrally on a conical piece slidable axially against an inner spring, each of said flanging and swaging roller being brought into and out of engagement with one of said wobblers for formation of a flanged and indented edge of said can body by radial displacement of said wobbler, both of said wobblers of said flanging and slaging heads cooperating with each other and at least one of said wobblers comprising:

two concentric ring members engaged with each other, of which the outer one having a larger outer diameter is stepped for receiving the inner one of a smaller outer diameter, a collar which supports said outer ring member which is guided axially slidable against an outer spring on said spindle so that said inner one of said ring members whose said outer diameter at most corresponds to the inner diameter of said can body before said flanging supports itself on said conical piece and said disklike abutting member and said ring members have bounding surfaces whose outer circumference fits the shape of said flanged and indented edge, said outer ring member has an L-shape cross section whose shorter leg forms an outer axially resilient ring segment of said outer ring member for guiding said ring members, and a stop for limiting the displacement of said slidable collar along said spindle so that the displacement of said slidable collar is smaller than said engagement depth of said inner ring member in said outer ring member, said stop comprising a circular shoulder directed inwardly which cooperates with a ringlike front surface formed on said spindle.

* * * * *